US008731439B2

(12) United States Patent
Kamimura

(10) Patent No.: US 8,731,439 B2
(45) Date of Patent: May 20, 2014

(54) COUPLING, IMAGE FORMING APPARATUS AND CARTRIDGE

(75) Inventor: Naoya Kamimura, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 75 days.

(21) Appl. No.: 13/294,377

(22) Filed: Nov. 11, 2011

(65) Prior Publication Data

US 2012/0121294 A1 May 17, 2012

(30) Foreign Application Priority Data

Nov. 12, 2010 (JP) ..... 2010-254090

(51) Int. Cl.
*G03G 15/00* (2006.01)

(52) U.S. Cl.
USPC ..... 399/167

(58) Field of Classification Search
USPC ..... 399/167
See application file for complete search history.

(56) References Cited

U.S. PATENT DOCUMENTS

| | | | | |
|---|---|---|---|---|
| 5,768,656 | A * | 6/1998 | Nagasue et al. | 399/75 |
| 5,983,753 | A | 11/1999 | Kostiza | |
| 7,894,737 | B2 | 2/2011 | Shimizu | |
| 2008/0008134 | A1 | 1/2008 | Satou et al. | |
| 2008/0138113 | A1* | 6/2008 | Murrell et al. | 399/167 |
| 2008/0138115 | A1* | 6/2008 | Chadani et al. | 399/167 |
| 2009/0169253 | A1 | 7/2009 | Kamimura et al. | |
| 2009/0169258 | A1 | 7/2009 | Kamimura | |
| 2010/0080581 | A1 | 4/2010 | Shimizu | |
| 2010/0080635 | A1 | 4/2010 | Kamimura | |

FOREIGN PATENT DOCUMENTS

| | | | |
|---|---|---|---|
| JP | 4-181965 | A | 6/1992 |
| JP | 8-054047 | A | 2/1996 |
| JP | 9-185200 | A | 7/1997 |
| JP | 2000500727 | A | 1/2000 |
| JP | 2000-327165 | A | 11/2000 |
| JP | 2002-072766 | A | 3/2002 |
| JP | 2008-017096 | | 1/2008 |
| JP | 2009-157310 | | 7/2009 |
| JP | 2009-162913 | | 7/2009 |
| JP | 2010-079160 | A | 4/2010 |
| JP | 2010-079204 | | 4/2010 |

OTHER PUBLICATIONS

JP Office Action dtd Jan. 29, 2013, JP Appln. 2010-254090, English translation.

Notification of the First Office Action with Search Report in related Chinese Patent Application No. 201110358507.0 mailed Dec. 6, 2013.

* cited by examiner

*Primary Examiner* — G. M. Hyder
(74) *Attorney, Agent, or Firm* — Banner & Witcoff, Ltd.

(57) ABSTRACT

A coupling which may include a driving side member, a driven side member, and an intermediate member interposed between the driving side member and the driven side member. The intermediate member may be configured to transmit a driving force from the driving side member to the driven side member. The driven side member may include a first driven side rotating body having a first engaging portion and a second driven side rotating body having a second engaging portion. Further, the second driven side rotating body may be configured to rotate relative to the first driven side rotating body about a common axis of rotation with the first driven side rotating body. Additionally, the second engaging portion may be disposed outside of the first engaging portion with respect to a radial direction of the first driven side rotating body.

9 Claims, 12 Drawing Sheets

COUPLING, IMAGE FORMING APPARATUS AND CARTRIDGE

CROSS REFERENCE TO RELATED APPLICATION

This application claims priority from Japanese Patent Application No. 2010-254090 filed Nov. 12, 2010, the entire subject matter of which is incorporated herein by reference.

FIELD OF DISCLOSURE

The present disclosure relates to a coupling and an image forming apparatus having a coupling. Particular aspects of the disclosure relate to an Oldham coupling and an image forming apparatus having an Oldham coupling.

BACKGROUND

In an example of an image forming apparatus such as a laser printer, a cleaning roller for removing extraneous matter such as residual toner and paper debris on the peripheral surface of a photosensitive drum is provided. The cleaning roller is disposed so that the peripheral surface thereof is in contact with the peripheral surface of the photosensitive drum. The cleaning roller rotates so that the part thereof in contact with the peripheral surface of the photosensitive drum moves in the same direction as the moving direction of the peripheral surface of the photosensitive drum.

The driving force for rotating the cleaning roller is transmitted from the photosensitive drum. That is, at one end of the photosensitive drum, a drum gear that rotates integrally with the photosensitive drum is provided. On the other hand, at one end of the cleaning roller, a cleaning gear that rotates integrally with the cleaning roller is provided. The cleaning gear meshes with the drum gear. When driving force is input into the photosensitive drum, the photosensitive drum rotates, the driving force is transmitted from the drum gear to the cleaning gear, and the cleaning roller rotates.

However, since the drum gear and the cleaning gear are meshing with each other, the meshing state thereof may cause unevenness of the rotation speed of the drum gear (the photosensitive drum) and may cause banding (stripes appearing in an image due to uneven density).

SUMMARY

Aspects of the present disclosure relate to a coupling that can stabilize the rotation speed of a member (e.g., a driven member) coupled to a first driven side rotating body. According to particular aspects of the present disclosure the coupling may be an Oldham coupling. Another aspect of the present disclosure relates to an image forming apparatus that can stabilize the rotation speed of a photosensitive drum.

Further, aspects of the disclosure may relate to a coupling (e.g., an Oldham coupling) which may include a driving side member, a driven side member, and an intermediate member interposed between the driving side member and the driven side member. The intermediate member may be configured to transmit a driving force from the driving side member to the driven side member. The driven side member may include a first driven side rotating body having a first engaging portion and a second driven side rotating body having a second engaging portion. Further, the second driven side rotating body may be configured to rotate relative to the first driven side rotating body about a common axis of rotation with the first driven side rotating body. Additionally, the second engaging portion may be disposed outside of the first engaging portion with respect to a radial direction of the first driven side rotating body. Also, the intermediate member may include a first joint having a first engaged portion configured to engage with the first engaging portion and a second joint having a second engaged portion configured to engage with the second engaging portion.

Additional aspects of the disclosure may relate to and image forming apparatus which may include a photosensitive drum configured to rotate about an axis of rotation, a driven member disposed proximate the photosensitive drum and configured to be rotationally driven about an axis parallel to the axis of rotation of the photosensitive drum and a driving member. Further, the image forming apparatus may include a coupling configured to transmit a driving force from the driving member to the photosensitive drum and the driven member simultaneously and independently of each other.

Further aspects of the disclosure may relate to a cartridge which includes a photosensitive drum configured to rotate about an axis of rotation, a driven side member and a driven member disposed proximate the photosensitive drum and configured to be rotationally driven about an axis parallel to the axis of rotation of the photosensitive drum. The driven side member may include a first driven side rotating body having a first engaging portion and a second driven side rotating body having a second engaging portion. The second driven side rotating body may be configured to rotate relative to the first driven side rotating body about a common axis of rotation with the first driven side rotating body. The second engaging portion may be disposed outside of the first engaging portion with respect to a radial direction of the first driven side rotating body. The first driven side rotating body may be configured to transmit a driving force to the photosensitive drum and the second driven side rotating body may be configured to transmit a driving force to the driven member.

DETAILED DESCRIPTION

Figure 1:
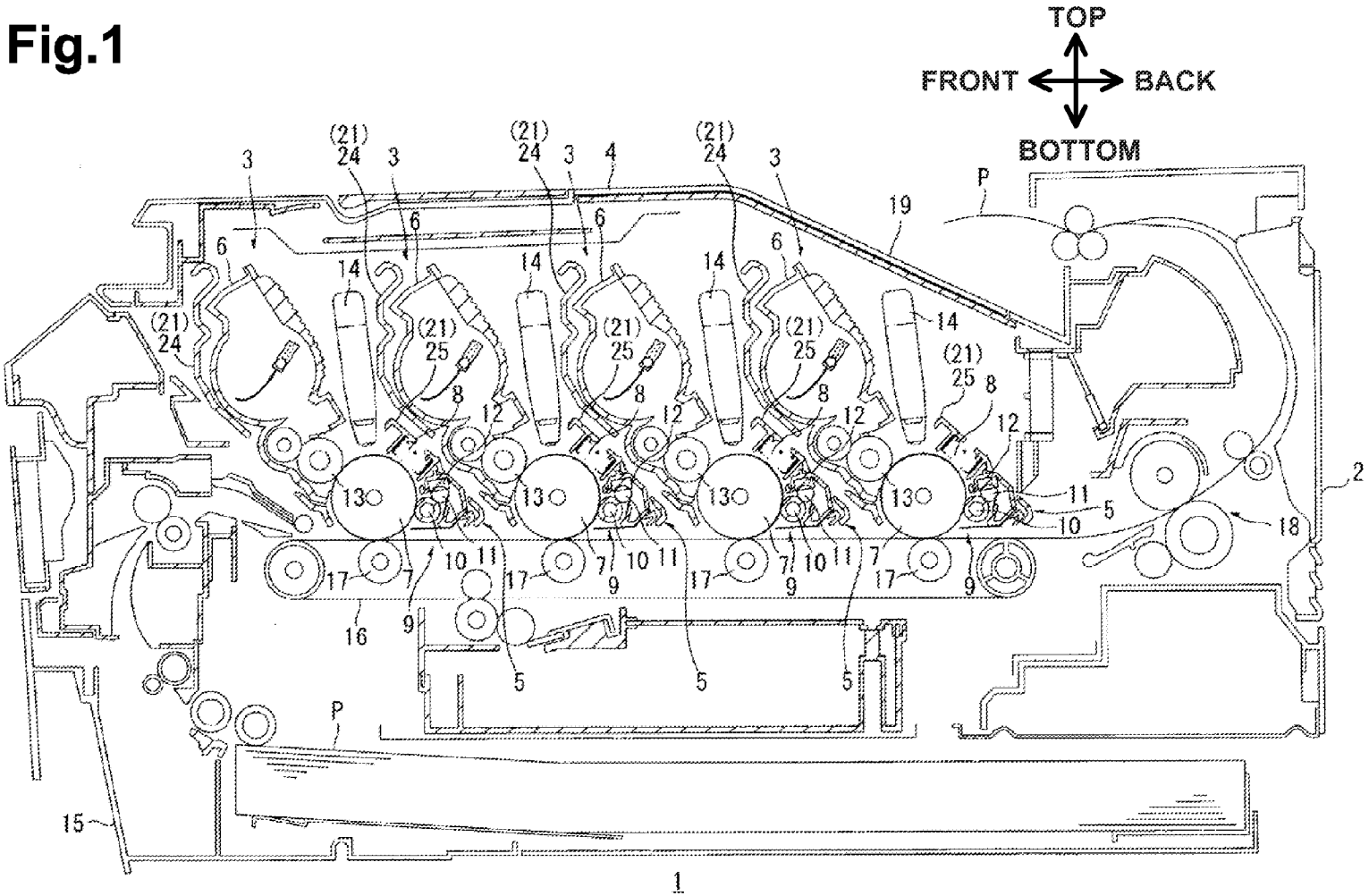
FIG. 1 is a sectional view of a color printer according to an embodiment of the present disclosure.

According to particular aspects of the disclosure, a coupling (e.g., an Oldham coupling) may include a driving side member, a driven side member, and an intermediate member. The driven side member may have a first driven side rotating body having a first engaging portion, and a second driven side rotating body having a second engaging portion. Further, the intermediate member may include a first joint having a first engaged portion, and a second joint having a second engaged portion.

The first engaged portion and the second engaged portion may be configured engage with the first engaging portion and the second engaging portion, respectively. The second driven side rotating body may be configured to rotate relative to the first driven side rotating body about a common axis of rotation with the first driven side rotating body. Therefore, the driving force transmitted from the driving side member to the intermediate member may be transmitted via the first joint (e.g., the first engaged portion and the first engaging portion) to the first driven side rotating body. Independently therewith, the driving force transmitted from the driving side member to the intermediate member may be transmitted via the second joint (e.g., the second engaged portion and the second engaging portion) to the second driven side rotating body.

Since the route via which driving force is transmitted from the driving side member to the first driven side rotating body differs from the route via which driving force is transmitted from the driving side member to the second driven side rotating body, the rotation of the first driven side rotating body and the rotation of the second driven side rotating body do not affect each other. It is noted that if the rotation of the second driven side rotating body affects the rotation of the first driven side rotating body, and unevenness of the rotation speed of the second driven side rotating body occurs, the unevenness of the rotation speed is transmitted from the second driven side rotating body via the second joint, the driving side member, and the first joint to the first driven side rotating body. Therefore, the unevenness of rotation speed disappears before being transmitted from the second driven side rotating body to the first driven side rotating body. Thus, the rotation speed of a member coupled with the first driven side rotating body can be stabilized.

According to additional particular aspects of the disclosure, a driven member rotationally driven about an axis parallel to the axis of rotation of a photosensitive drum is disposed proximate the photosensitive drum. Driving force from a driving member is transmitted via an Oldham coupling to the photosensitive drum and the driven member in parallel (e.g., simultaneously and independently).

Since the route via which driving force is transmitted from the driving side member to the photosensitive drum differs from the route via which driving force is transmitted from the driving side member to the driven member, the rotation of the first driven side rotating body and the rotation of the second driven side rotating body do not affect each other. Thus, the rotation speed of the photosensitive drum can be stabilized. Embodiments of the present disclosure will be described in detail with reference to the drawings.

First Embodiment

1. Color Printer

According to aspects of the disclosure, the image forming apparatus may be a color printer, such as a tandem-type color printer. For example, FIG. 1 illustrates a color printer 1 as an example of an image forming apparatus. The color printer 1 has a main body casing 2. In the main body casing 2, four process cartridges 3 are disposed in parallel in a predetermined direction. The four process cartridges 3 are provided for colors of black, yellow, magenta, and cyan, and are disposed in the order of black, yellow, magenta, and cyan from one side in the predetermined direction. Each process cartridge 3 can be attached to and removed from the main body casing 2 in a state where a top cover 4 at the top of the main body casing 2 is open.

In the following description, the side on which the black process cartridges 3 is disposed (the left side in FIG. 1) will be referred to as front, and the directions of top, bottom, left, and right will be defined as those when each part of the color printer 1 (including the process cartridges 3) is viewed from the front.

Each process cartridge 3 may have a drum cartridge 5, and a developing cartridge 6 that can be attached to and removed from the drum cartridge 5. The drum cartridge 5 may have a photosensitive drum 7, a charger 8, and a cleaner 9. The charger 8 is, for example, a scorotron charger having a wire and a grid. The charger 8 may be disposed behind and above the photosensitive drum 7.

The cleaner 9 may be disposed behind the photosensitive drum 7 and behind and below the charger 8. The cleaner 9 may have a primary cleaning roller 10 that is configured to contact the surface of the photosensitive drum 7 and removes extraneous matter from the surface, a secondary cleaning roller 11 that is configured to contact the surface of the primary cleaning roller 10 and removes extraneous matter transferred from the surface of the photosensitive drum 7 to the surface of the primary cleaning roller 10 from the surface, and a contact member 12 that is configured to contact the surface of the secondary cleaning roller 11 and scrape off extraneous matter transferred from the surface of the primary cleaning roller 10 to the surface of the secondary cleaning roller 11.

The primary cleaning roller 10 and the secondary cleaning roller 11 may be provided rotatably about an axis of rotation extending in the left-right direction. The primary cleaning roller 10 may come into contact with the photosensitive drum 7 from behind. The secondary cleaning roller 11 may come into contact with the primary cleaning roller 10 from behind and above. The contact member 12 may come into contact with the secondary cleaning roller 11 from above.

The developing cartridge 6 has a developing roller 13. In a state where the developing cartridge 6 is attached to the drum cartridge 5, the developing roller 13 may come into contact with the surface of the photosensitive drum 7 from the front and above. In the main body casing 2, each photosensitive drum 7 is provided with an LED unit 14. The tip of the LED unit 14 faces the peripheral surface of the photosensitive drum 7 corresponding to the LED unit 14.

The surface of the photosensitive drum 7 is evenly charged by the discharge from the charger 8 and is then selectively exposed by an LED provided in the LED unit 14. By this exposure, charge is selectively removed from the surface of the photosensitive drum 7, and an electrostatic latent image is formed on the surface of the photosensitive drum 7. When the electrostatic latent image faces the developing roller 13, toner is supplied from the developing roller 13 to the electrostatic latent image. Thus, a toner image is formed on the surface of the photosensitive drum 7.

In the bottom of the main body casing 2, a paper cassette 15 in which paper P is loaded is disposed. Paper P loaded in the paper cassette 15 is conveyed by various rollers onto a conveying belt 16. The conveying belt 16 is disposed so as to face the four photosensitive drums 7 from below. At each of the positions facing the photosensitive drums 7 with the upper part of the conveying belt 16 therebetween, a transfer roller 17 is disposed. The paper P conveyed onto the conveying belt 16 passes through the gaps between the conveying belt 16 and the photosensitive drums 7 in sequence, with the rotation of the conveying belt 16. The toner image on the surface of each photosensitive drum 7 is transferred to the paper P when it faces the paper P.

On the downstream side in the paper P conveying direction of the conveying belt 16, a fixing device 18 is provided. The paper P to which toner images are transferred is conveyed to the fixing device 18. In the fixing device 18, by heating and pressing, the toner images are fixed to the paper P. The paper P to which the toner images are fixed is ejected by various rollers onto a paper ejection tray 19 at the top of the main body casing 2.

2. Drum Cartridge (1) Frame

Figure 2:
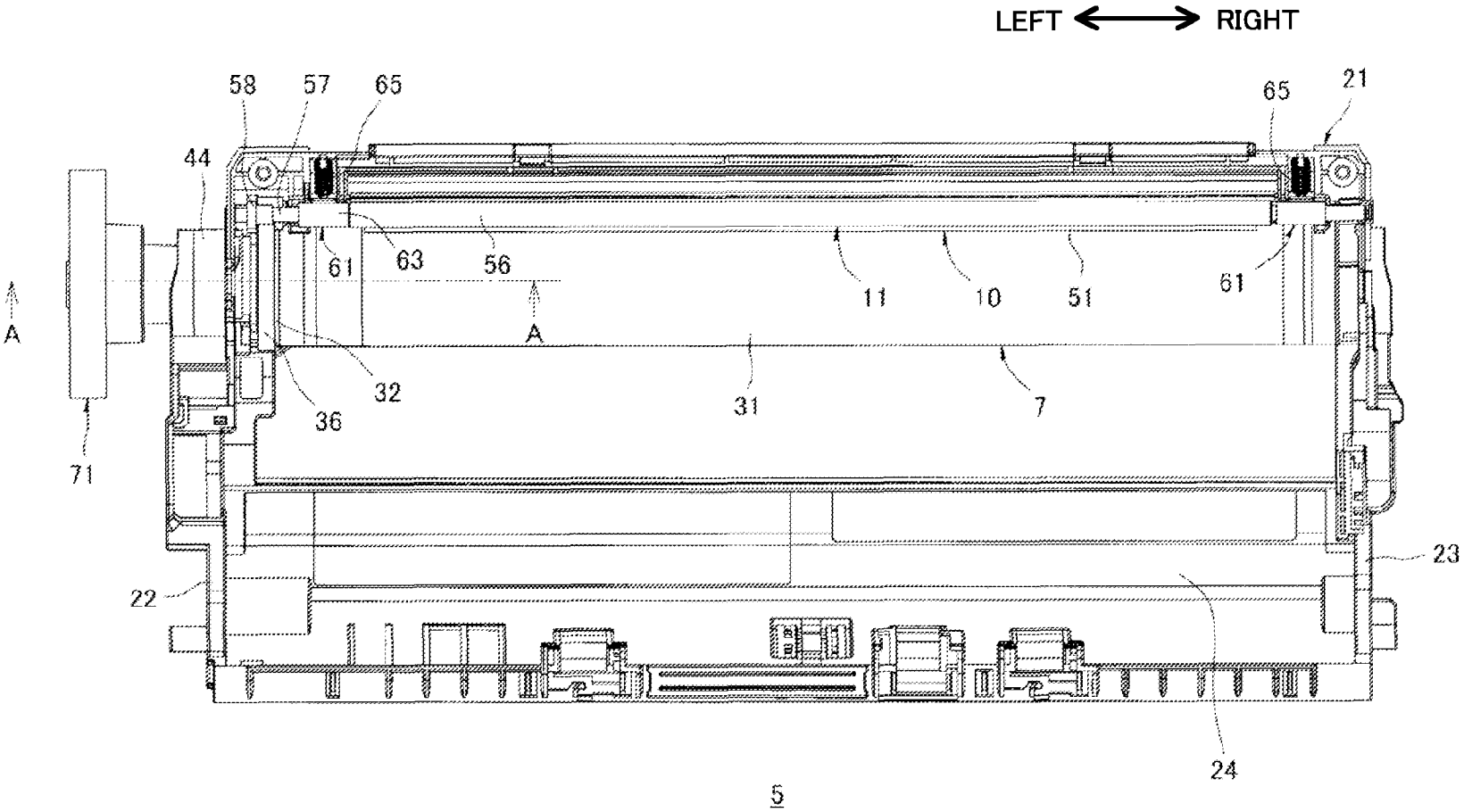
FIG. 2 is a view of the drum cartridge shown in FIG. 1 as viewed from above and behind, and also shows a drive transmitting member.

As shown in FIGS. 1 and 2, the drum cartridge 5 has a frame 2. As shown in FIG. 2, the frame 21 has a pair of side plates 22 and 23 that are spaced apart in the left-right direction and face each other. As shown in FIGS. 1 and 2, the frame 21 has a bottom plate 24 that is disposed between the front edges of the pair of side plates 22 and 23 and slopes upward toward the front. As shown in FIG. 1, the frame 21 has a cover plate 25 that is disposed between the back edges of the lower ends of the side plates 22 and 23, is spaced apart from the bottom plate 24, and slopes upward toward the front. In FIG. 2, the drum cartridge 5 from which the cover plate 25 is removed is shown.

In the space between the bottom plate 24 and the cover plate 25, the photosensitive drum 7, the charger 8, the primary cleaning roller 10, the secondary cleaning roller 11, and the contact member 12 are housed. The photosensitive drum 7, the primary cleaning roller 10, and the secondary cleaning roller 11 are rotatably provided between the pair of side plates 22 and 23. The charger 8 and the contact member 12 are held by the cover plate 25. The developing cartridge 6 is attached on a part of the bottom plate 24 not facing the cover plate 25.

(2) Photosensitive Drum

Figure 3:
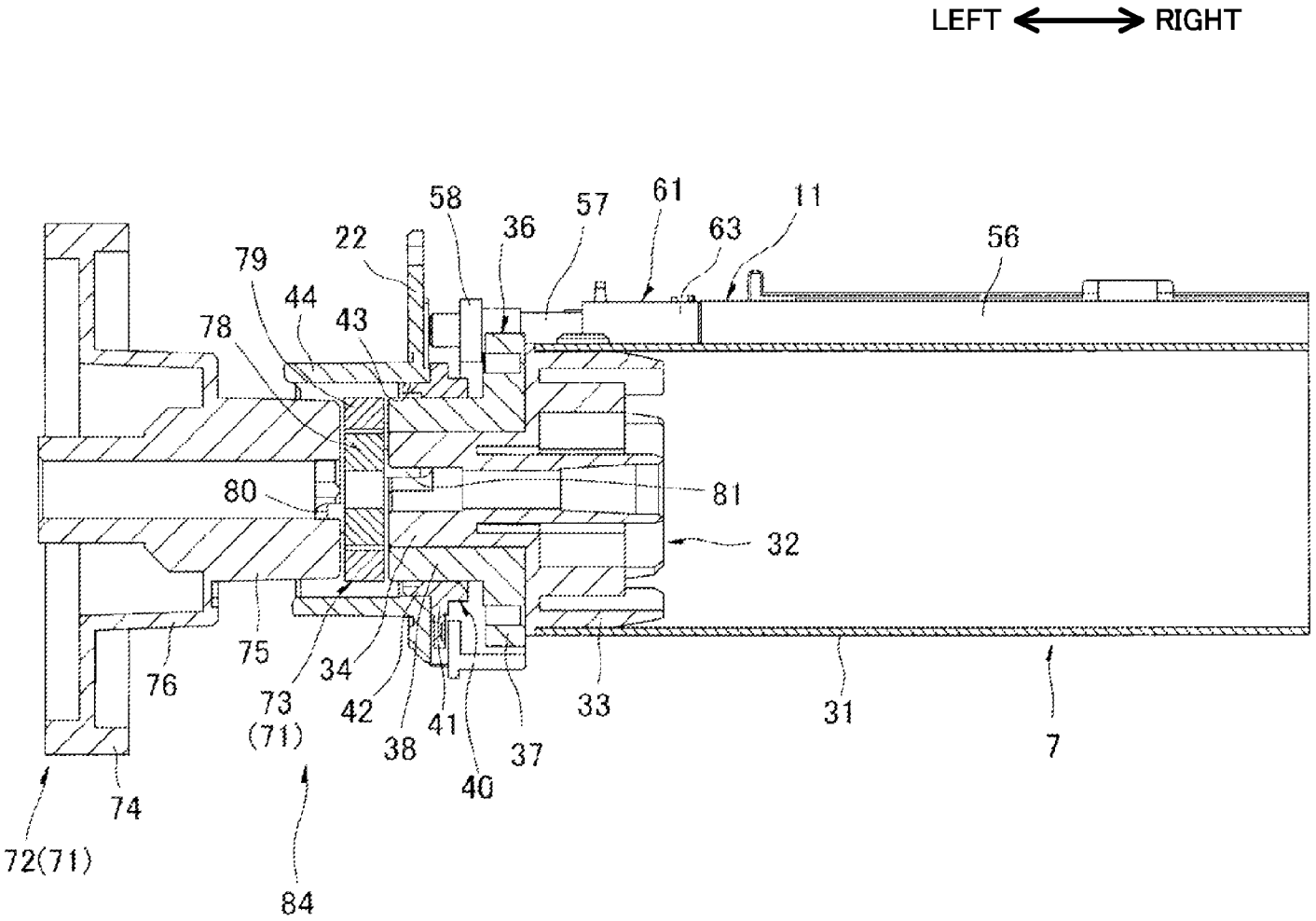
FIG. 3 is a sectional view of the drum cartridge taken along line A-A of FIG. 2.

As shown in FIG. 3, the photosensitive drum 7 has a cylindrical drum main body 31 and a flange 32 fixed to the left end of the drum main body 31. The flange 32 may be an example of a first driven side rotating body or at least a part of the first driven side rotating body and an example of a driven side member or at least a part of a driven side member. The drum main body 31 may be made of an electrically-conductive material such as aluminum. On the surface of the drum main body 31, a photosensitive layer of a positive electrostatic property made, for example, of polycarbonate may be formed.

Figure 4:
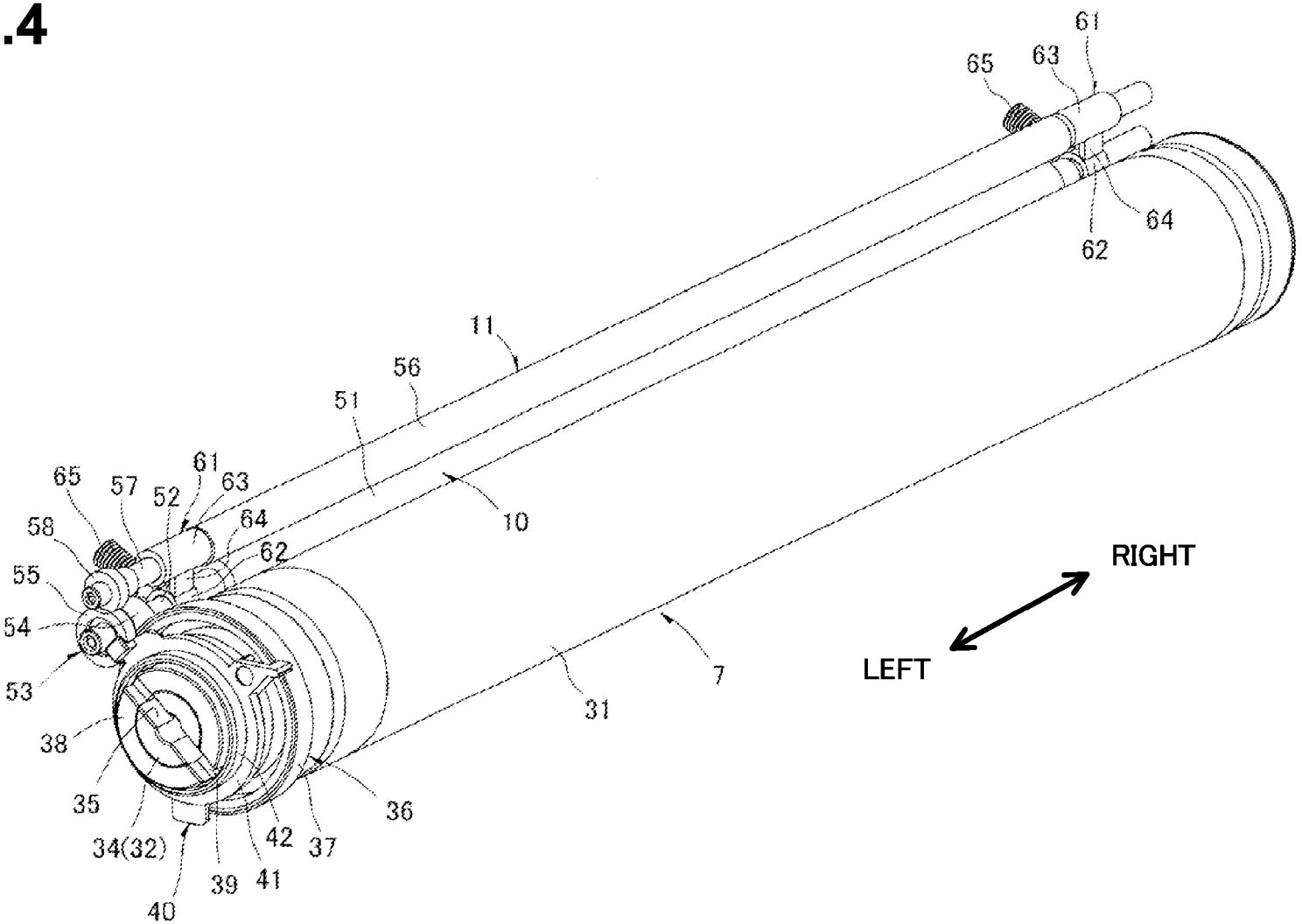
FIG. 4 is a perspective view of the photosensitive drum, the primary cleaning roller, and the secondary cleaning roller shown in FIG. 2.

The flange 32 may be made of resin. The flange 32 may integrally have a fixing portion 33 that is fixed to the inside of the left end of the drum main body 31 by press fitting, and a substantially cylindrical boss portion 34 that extends leftward from the central part of the outer end surface of the fixing portion 33. As seen in FIG. 4, in the outer end surface (tip surface) of the boss portion 34, a driven side first groove 35 extending straight along the diameter thereof may be formed.

On the boss portion 34, a cleaning driving gear 36 is rotatably fitted. The cleaning driving gear 36 may be an example of a second driven side rotating body or at least a part of a second driven side rotating body and an example of a driven side member or at least a part of a driven side member. The cleaning driving gear 36 may be made of resin. The cleaning driving gear 36 may integrally have a ring-plate-shaped gear portion 37 having gear teeth (not shown) formed on the outer peripheral surface thereof, and a cylindrical portion 38 extending leftward from the circumference of the circular hole formed in the central part of the gear portion 37. The outer end surface (tip surface) of the cylindrical portion 38 may be coplanar with the outer end surface of the boss portion 34 of the flange 32. In the outer end surface of the cylindrical portion 38, a driven side second groove 39 extending straight along the diameter thereof may be formed. The driven side second groove 39 may have the same width as the driven side first groove 35 in the outer end surface of the boss portion 34. As seen, according to aspects of the disclosure the driven side second groove 39 may be disposed outside of the driven side first groove 35 with respect to a radial direction of the flange 32.

On the cylindrical portion 38, a drum bearing 40 may be fitted. The drum bearing 40 may be made of resin. The drum bearing 40 may integrally have a ring-plate-shaped bearing main body portion 41, and a cylindrical inserting portion 42 extending leftward from the circumference of a circular hole in the central part of the bearing main body portion 41.

In the left side plate 22 of the frame 21, a circular holding hole 43 may be formed that has an inside diameter substantially equal to the outside diameter of the inserting portion 42 of the drum bearing 40. On the side plate 22, a cylindrical protecting portion 44 extending leftward from the circumference of the holding hole 43 may be integrally formed.

The inserting portion 42 of the drum bearing 40 may be inserted into the holding hole 43 from the right side. The drum bearing 40 may be fixed to the side plate 22. The right end of the drum main body 31 may be rotatably held by the right side plate 23 and the photosensitive drum 7 may thereby be provided rotatably about an axis extending in the left-right direction between the left and right side plates 22 and 23. The driven side first groove 35 of the flange 32 and the driven side second groove 39 of the cleaning driving gear 36 may be exposed on the left side in the inside of the protecting portion 44.

(3) Primary Cleaning Roller

As shown in FIG. 4, the primary cleaning roller 10 as an example of a driven member may have a cylindrical roller main body 51, and a roller shaft 52 extending along the central axis of the roller main body 51 and protruding from both end surfaces of the roller main body 51. The roller main body 51 may be made of a sponge material. For example, the primary cleaning roller 10 is not limited to a sponge roller having a roller main body 51 made of a sponge material, and may be a so-called brush roller having a roller main body 51 on the peripheral surface of which a large number of brush bristles are planted.

To the left end of the roller shaft 52, a primary cleaning gear 53 may be attached that is spaced apart from the roller main body 51. The primary cleaning gear 53 may be a dual gear integrally having an input gear portion 54 and an output gear portion 55. The input gear portion 54 may have a cylindrical shape. On the peripheral surface of the input gear portion 54, gear teeth (not shown) may be formed that mesh with the cleaning driving gear 36. The gear teeth of the input gear portion 54 may be configured to mesh with the gear teeth of the cleaning driving gear 36. The output gear portion 55 may be provided on the left side of the input gear portion 54 and have a flattened cylindrical shape having a diameter (gear diameter) larger than that of the input gear portion 54. On the peripheral surface of the output gear portion 55, gear teeth (not shown) may be formed. The roller shaft 52 may be unrotatably inserted into the hollows of the input gear portion 54 and the output gear portion 55, and the primary cleaning gear 53 is thereby configured to rotate with the roller shaft 52.

(4) Secondary Cleaning Roller

The secondary cleaning roller 11 may be made of metal, and as shown in FIG. 4, it may integrally have a cylindrical roller main body portion 56, and a roller shaft portion 57 extending along the central axis of the roller main body portion 56 and protruding from both end surfaces of the roller main body portion 56.

To the left end of the roller shaft portion 57, a secondary cleaning gear 58 may be attached that is spaced apart from the roller main body portion 56. The secondary cleaning gear 58 may have a flattened cylindrical portion on the peripheral surface of which gear teeth (not shown) may be formed. The roller shaft portion 57 is unrotatably inserted into the hollow of the cylindrical portion, and the secondary cleaning gear 58 is thereby configured to be rotated with the roller shaft portion 57. The gear teeth of the secondary cleaning gear 53 may be configured to mesh with the output gear portion 55 of the primary cleaning gear 53.

(5) Shaft Coupling Member

As shown in FIG. 4, the roller shaft 52 of the primary cleaning roller 10 and the roller shaft portion 57 of the secondary cleaning roller 11 may be coupled at both ends thereof by shaft coupling members 61. The shaft coupling members 61 each may integrally have a cylindrical first inserting portion 62 into which the roller shaft 52 may be rotatably inserted, a cylindrical second inserting portion 63 into which the roller shaft portion 57 may be rotatably inserted, and a coupling portion 64 that couples the first inserting portion 62 and the second inserting portion 63 together. The left shaft coupling member 61 may be provided between (1) the roller main body 51 of the primary cleaning roller 10 and the roller main body portion 56 of the secondary cleaning roller 11 and (2) the primary cleaning gear 53 and the secondary cleaning gear 58.

To the first inserting portion 62, one end of a coil spring 65 may be connected. The other end of the coil spring 65 may be connected, as shown in FIG. 2, to the frame 21 of the drum cartridge 5. The coil spring 65 may be interposed in a compressed state between the frame 21 and the first inserting portion 62. For this reason, the coil spring 65 urges the first inserting portion 62 toward the photosensitive drum 7, and the primary cleaning roller 10 is thereby elastically in contact with the surface of the photosensitive drum 7.

3. Drive Transmitting Member

In the main body casing 2 (see FIG. 1), as shown in FIG. 2, a drive transmitting member 71 configured to transmit the driving force for rotating the photosensitive drum 7, the primary cleaning roller 10, and the secondary cleaning roller 11 to the flange 32 and the cleaning driving gear 36 may be provided.

Figure 5:
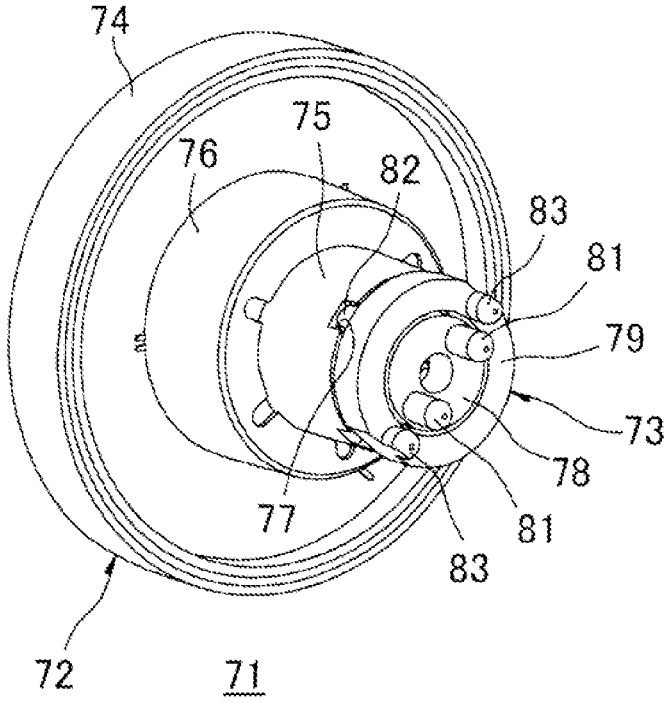
FIG. 5 is a perspective view of the drive transmitting member shown in FIG. 2.

As shown in FIGS. 3 and 5, the drive transmitting member 71 may have a drive transmitting gear 72 as an example of a driving side member. Further, the drive transmitting member 71 may have an intermediate member 73 that is interposed between the drive transmitting gear 72 and the flange 32 and the cleaning driving gear 36 and configured to couple the drive transmitting gear 72 and the flange 32 and the cleaning driving gear 36 together.

Figure 6:
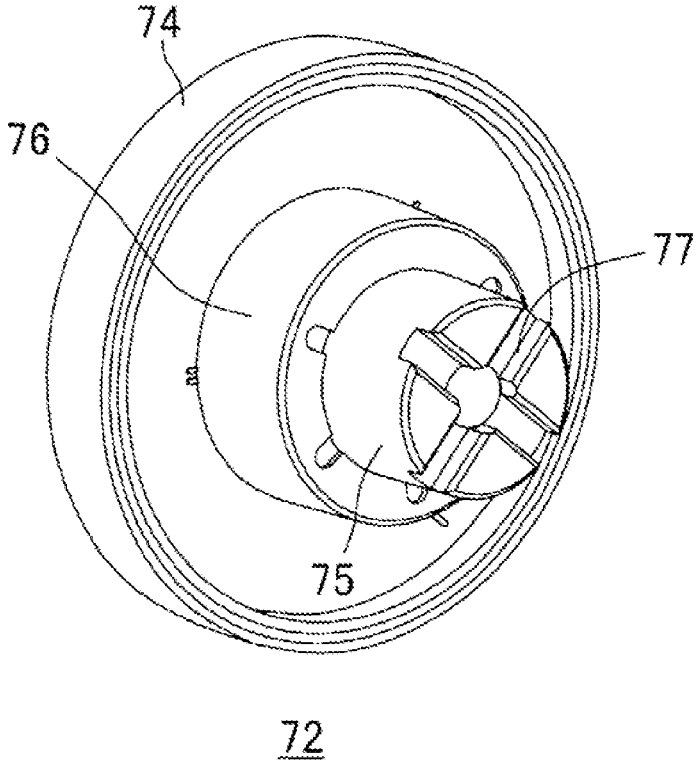
FIG. 6 is a perspective view of the drive transmitting gear shown in FIG. 5.

As shown in FIGS. 3 and 6, the drive transmitting gear 72 integrally have a cylindrical gear portion 74, a substantially cylindrical coupling portion 75 having a common central axis with the gear portion 74, and a connecting portion 76 connected to the inner peripheral surface of the gear portion 74 and the outer peripheral surface of the coupling portion 75. On the outer peripheral surface of the gear portion 74, gear teeth (not shown) may be formed.

The right end of the coupling portion 75 may protrude on the right side of the right end surface of the gear portion 74. As shown in FIG. 6, in the right end surface of the coupling portion 75, a cruciform driving side groove 77 crossing at the center thereof may be formed.

The connecting portion 76 may extend from the whole circumference of the inner peripheral surface of the gear portion 74 inward in the radial direction of the gear portion 74, bend rightward, bend inward in the radial direction, and be connected to the middle part in the left-right direction of the outer peripheral surface of the coupling portion 75.

As shown in FIG. 5, the intermediate member 73 may have a ring-plate-shaped first joint 78 having a relatively small diameter, and a ring-plate-shaped second joint 79 having a relatively large diameter.

Figure 7:
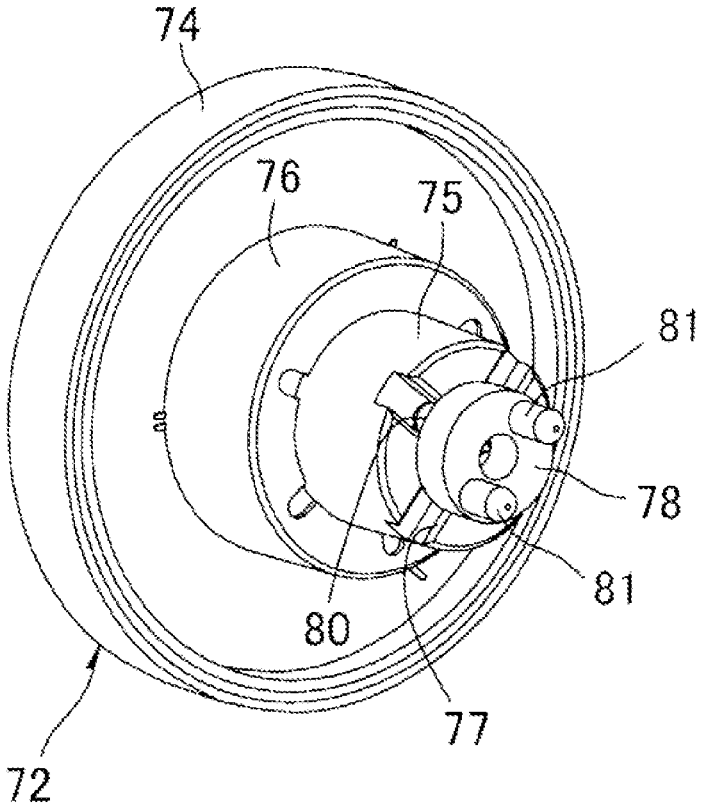
FIG. 7 is a perspective view of the drive transmitting gear and the first joint shown in FIG. 5.

On the left end surface of the first joint 78, as shown in FIG. 7, at two positions 180 degrees apart about the central axis of the first joint 78, cylindrical driving side first protrusions 80 each having a hemispherically-shaped tip may be formed so as to protrude leftward. Further, on the right end surface of the first joint 78, at two positions 180 degrees apart about the central axis of the first joint 78 and offset by 90 degrees about the central axis of the first joint 78 from the driving side first protrusions 80, cylindrical driven side first protrusions 81 each having a hemispherically-shaped tip may be formed so as to protrude rightward.

As shown in FIG. 5, the second joint 79 may surround the first joint 78. On the left end surface of the second joint 79, at two positions 180 degrees apart about the central axis of the second joint 79, cylindrical driving side second protrusions 82 each having a hemispherically-shaped tip may be formed so as to protrude leftward. Further, on the right end surface of the second joint 79, at two positions 180 degrees apart about the central axis of the second joint 79 and offset by 90 degrees about the central axis of the second joint 79 from the driving side second protrusions 82, cylindrical driven side second protrusions 83 each having a hemispherically-shaped tip may be formed so as to protrude leftward.

As shown in FIG. 5, the intermediate member 73 may be coupled to the coupling portion 75 of the drive transmitting gear 72. As shown in FIG. 7, the driving side first protrusions 80 of the first joint 78 may be configured to engage with the driving side groove 77 of the drive transmitting gear 72, and as shown in FIG. 5, the driving side second protrusions 82 of the second joint 79 may be configured to engage with the driving side groove 77 on the outer side in the radial direction with respect to the driving side first protrusions 80. The driven side first protrusions 81 of the first joint 78 and the driven side second protrusions 83 of the second joint 79 may be in alignment.

4. Coupling/Decoupling of Drive Transmitting Member to/from Drum Cartridge

As shown in FIG. 3, the drive transmitting member 71 may be disposed at a position facing the protecting portion 44 of the drum cartridge 5 installed in the main body casing 2, and provided advanceably and retractably in the left-right direction between an advanced position on the relatively right side and a retracted position on the relatively left side.

In a state where the drive transmitting member 71 is advanced to the advanced position, the tip (right end) of the coupling portion 75 of the drive transmitting gear 72 and the intermediate member 73 may be located inside the protecting portion 44. The driven side first protrusions 81 as an example of a first engaged portion and first protrusions of the first joint 78 and the driven side second protrusions 83 as an example of a second engaged portion and second protrusions of the second joint 79 may engage with the driven side first groove 35 as an example of a first engaging portion and a first groove of the flange 32 and the driven side second groove 39 as an example of a second engaging portion and a second groove of the cleaning driving gear 36, respectively. Thus, the flange 32, the cleaning driving gear 36, the drive transmitting gear 72, and the intermediate member 73 form an Oldham coupling. The drive transmitting gear 72 may be coupled to the flange 32 by the first joint 78 of the intermediate member 73, and may be coupled to the cleaning driving gear 36 by the second joint 79 of the intermediate member 73.

Further, in a state where the drive transmitting member 71 is retracted to the retracted position, the intermediate member 73 may be located outside the protecting portion 44, and the driven side first protrusions 81 of the first joint 78 and the driven side second protrusions 83 of the second joint 79 may be decoupled from the driven side first groove 35 of the flange 32 and the driven side second groove 39 of the cleaning driving gear 36, respectively.

5. Drive Transmission

The gear teeth of the drive transmitting gear 72 are configured to mesh with a main body driving gear (not shown) provided in the main body casing 2. Into the main body driving gear, the driving force of a motor (not shown) provided in the main body casing 2 is input. When the driving force is input from the motor into the main body driving gear, and the main body driving gear rotates, the driving force is transmitted from the main body driving gear to the drive transmitting gear 72.

In a state where the drive transmitting gear 72 is coupled to the flange 32 and the cleaning driving gear 36 by the intermediate member 73, the driving force transmitted to the drive transmitting gear 72 is transmitted from the drive transmitting gear 72 to the intermediate member 73, and is transmitted via the first joint 78 to the flange 32. Thus, the photosensitive drum 7 rotates together with the flange 32.

In parallel therewith (e.g., simultaneously and independently), the driving force transmitted from the drive transmitting gear 72 to the intermediate member 73 is transmitted via the second joint 79 to the cleaning driving gear 36. Thus, the cleaning driving gear 36 rotates, the driving force is transmitted from the cleaning driving gear 36 to the primary cleaning gear 53, and the primary cleaning roller 10 rotates together with the primary cleaning gear 53. The driving force is transmitted from the primary cleaning gear 53 to the secondary cleaning gear 58, and the secondary cleaning roller 11 rotates together with the secondary cleaning gear 58.

6. Operation Effect

As described above, the flange 32, the cleaning driving gear 36, the drive transmitting gear 72, and the intermediate member 73 may form a coupling (e.g., an Oldham coupling) 84. The flange 32 has a driven side first groove 35. The cleaning driving gear 36 has a driven side second groove 39. The intermediate member 73 has a first joint 78 having a driven side first protrusions 81, and a second joint 79 having a driven side second protrusions 83.

The driven side first protrusions 81 and the driven side second protrusions 83 engage with the driven side first groove 35 and the driven side second groove 39, respectively. The cleaning driving gear 36 is configured to rotate relative to the flange 32 about a common axis of rotation with the flange 32. For this reason, the driving force transmitted from the drive transmitting gear 72 to the intermediate member 73 is transmitted to the flange 32 via the first joint 78 (the driven side first protrusions 81 and the driven side first groove 35). In parallel therewith (e.g., simultaneously and independently), the driving force transmitted from the drive transmitting gear 72 to the intermediate member 73 is transmitted to the cleaning driving gear 36 via the second joint 79 (the driven side second protrusions 83 and the driven side second groove 39).

Since the route via which driving force is transmitted from the drive transmitting gear 72 to the flange 32 differs from the route via which driving force is transmitted from the drive transmitting gear 72 to the cleaning driving gear 36, the rotation of the flange 32 and the rotation of the cleaning driving gear 36 do not affect each other. If the rotation of the cleaning driving gear 36 affects the rotation of the flange 32, and unevenness of the rotation speed of the cleaning driving gear 36 occurs, the unevenness of the rotation speed is transmitted from the cleaning driving gear 36 via the second joint 79, the drive transmitting gear 72, and the first joint 78 to the flange 32. For this reason, the unevenness of rotation speed disappears before being transmitted from the cleaning driving gear 36 to the flange 32. Thus, the rotation speed of the photosensitive drum 7 coupled with the flange 32 can be stabilized.

Second Embodiment

Figure 8:
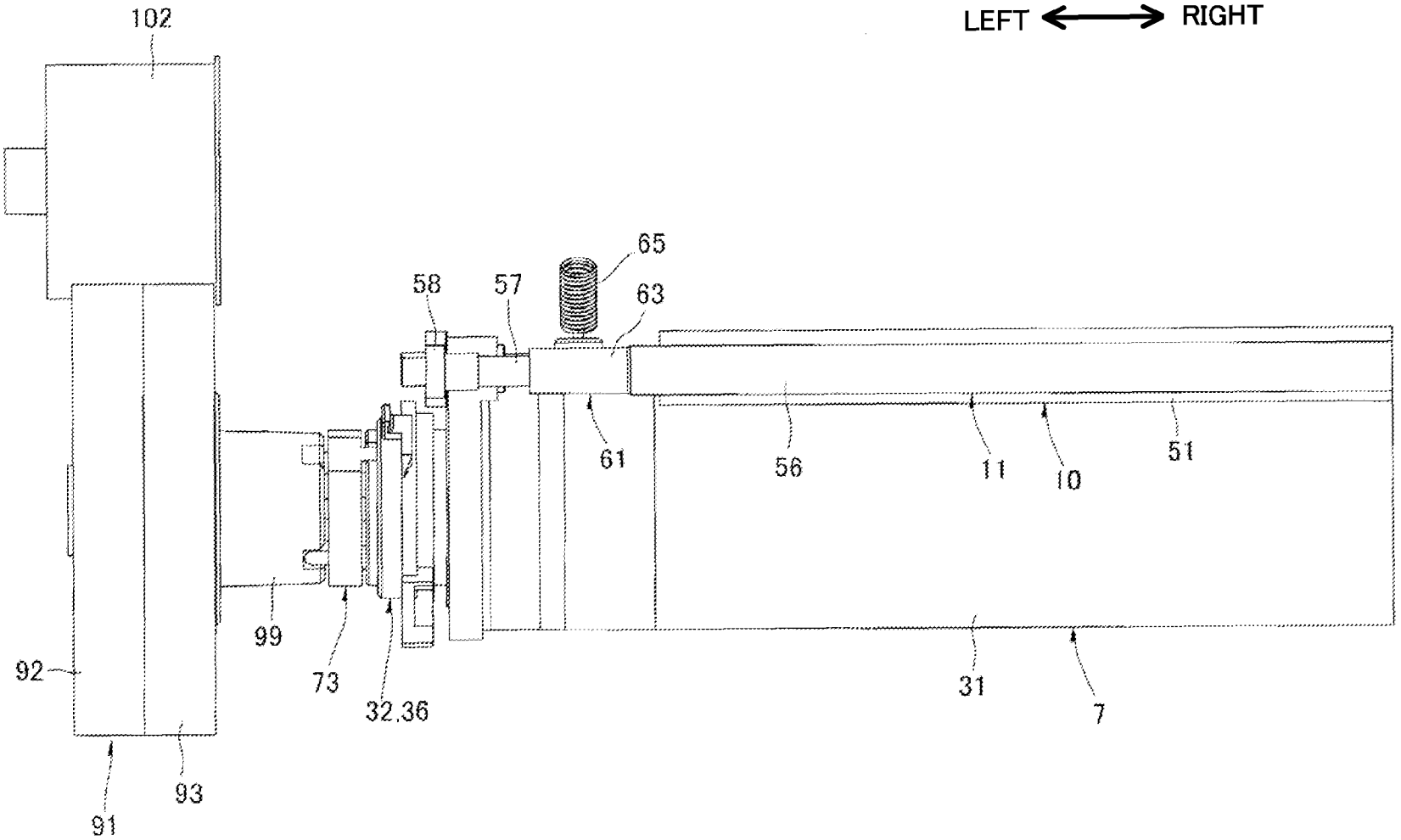
FIG. 8 is a view of a photosensitive drum, a primary cleaning roller, a secondary cleaning roller, a drive transmitting member, and a main body driving gear according to another embodiment of the present disclosure as viewed from above and behind.
Figure 9:
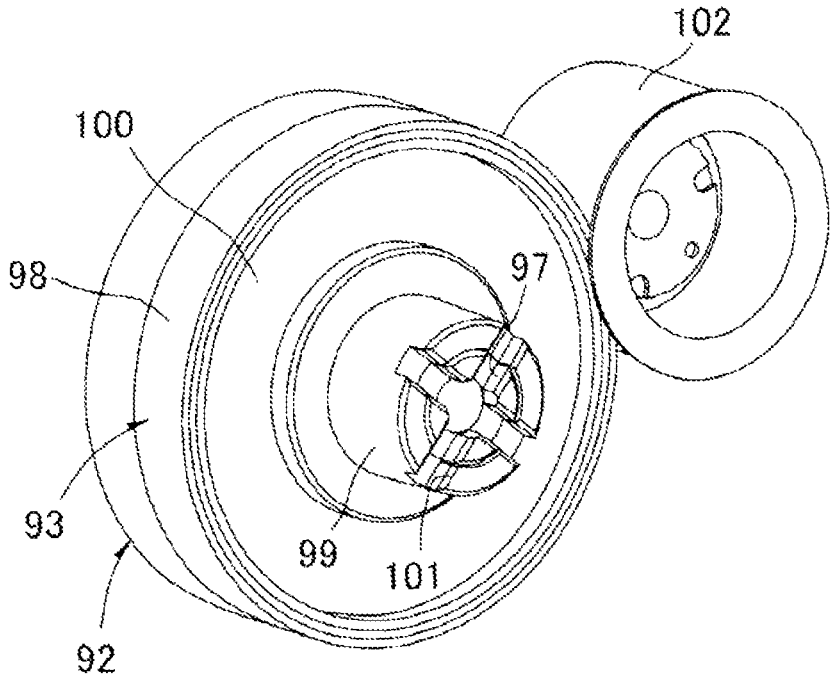
FIG. 9 is a perspective view of the drive transmitting gear and the main body driving gear shown in FIG. 8.

Instead of the drive transmitting gear 72 shown in FIG. 6, the drive transmitting gear 91 shown in FIGS. 8 and 9 may be used.

The drive transmitting gear 91 has a first gear 92 as an example of a first driving side rotating body, and a second gear 93 as an example of a second driving side rotating body configured to rotate relative to the first gear 92 about a common axis of rotation with the first gear 92. It is noted that according to aspects of the disclosure, the first driving side rotating body may be independent from the second driving side rotating body.

Figure 10:
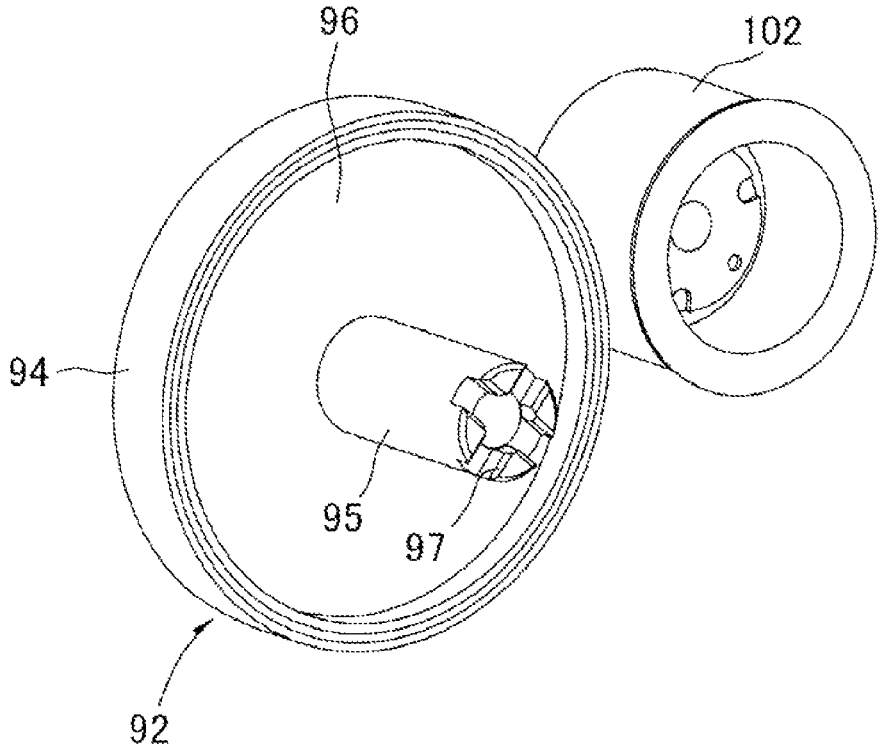
FIG. 10 is a perspective view of the first gear and the main body driving gear shown in FIG. 9.

As shown in FIG. 10, the first gear 92 may integrally have a cylindrical gear portion 94, a substantially cylindrical coupling portion 95 having a common central axis with the gear portion 94, and a connecting portion 96 connected to the inner peripheral surface of the gear portion 94 and the outer peripheral surface of the coupling portion 95. On the outer peripheral surface of the gear portion 94, gear teeth (not shown) are formed.

The right end of the coupling portion 95 is protruding on the right side of the right end surface of the gear portion 74. In the right end surface of the coupling portion 75, a cruciform first driving side groove 97 crossing at the center thereof is formed.

The connecting portion 96 extends from the whole circumference of the inner peripheral surface of the gear portion 94 inward in the radial direction of the gear portion 94, and is connected to the outer peripheral surface of the coupling portion 95.

As shown in FIG. 9, the second gear 93 may integrally have a cylindrical gear portion 98 having the same diameter as the gear portion 94 of the first gear 92, a coupling portion 99 formed in a substantially cylindrical shape, having a common central axis with the gear portion 98, and fitted on the coupling portion 95 of the first gear 92, and a connecting portion 100 connected to the inner peripheral surface of the gear portion 98 and the outer peripheral surface of the coupling portion 95. On the outer peripheral surface of the gear portion 98, gear teeth (not shown) are formed.

The right end surface of the coupling portion 99 is coplanar with the right end surface of the coupling portion 95 of the first gear 92. In the right end surface of the coupling portion 99, a cruciform second driving side groove 101 crossing at the center thereof is formed.

The connecting portion 100 may extend from the whole circumference of the inner peripheral surface of the gear portion 98 inward in the radial direction of the gear portion 98, bend rightward, bend inward in the radial direction, and be connected to the outer peripheral surface of the coupling portion 99.

The driving side first protrusions 80 of the first joint 78 of the intermediate member 73 may be configured to engage with the first driving side groove 97 of the first gear 92. The driving side second protrusions 82 of the second joint 79 of the intermediate member 73 may be configured to engage with the second driving side groove 101 of the second gear 93.

The gear teeth of the first gear 92 and the gear teeth of the second gear 93 mesh with a main body driving gear 102 as an example of a driving member to which the driving force of a motor (not shown) is transmitted. When the driving force is input from the motor into the main body driving gear 102, and the main body driving gear 102 rotates, the driving force is transmitted from the main body driving gear 102 to the first gear 92 and the second gear 93. The driving force transmitted to the first gear 92 is transmitted via the first joint 78, the driven side first protrusions 81, and the driven side first groove 35 to the flange 32. In parallel therewith, the driving force transmitted to the second gear 93 is transmitted via the second joint 79, the driven side second protrusions 83, and the driven side second groove 39 to the cleaning driving gear 36.

Since the drive transmitting gear 91 has the first gear 92 and the second gear 93, if the rotation of the cleaning driving gear 36 affects the rotation of the flange 32, and unevenness of the rotation speed of the cleaning driving gear 36 occurs, the unevenness of the rotation speed is transmitted from the cleaning driving gear 36 via the second joint 79, the drive transmitting gear 92, the main body driving gear 102, the drive transmitting gear 91, and the first joint 78 to the flange 32. For this reason, in the configuration in which instead of the drive transmitting gear 72 shown in FIG. 6, the drive transmitting gear 91 is used, the route via which the unevenness of rotation speed is transmitted to the flange 32 is long. As a result, the rotation speed of the photosensitive drum 7 coupled with the flange 32 can be further stabilized.

Third Embodiment

Figure 11:
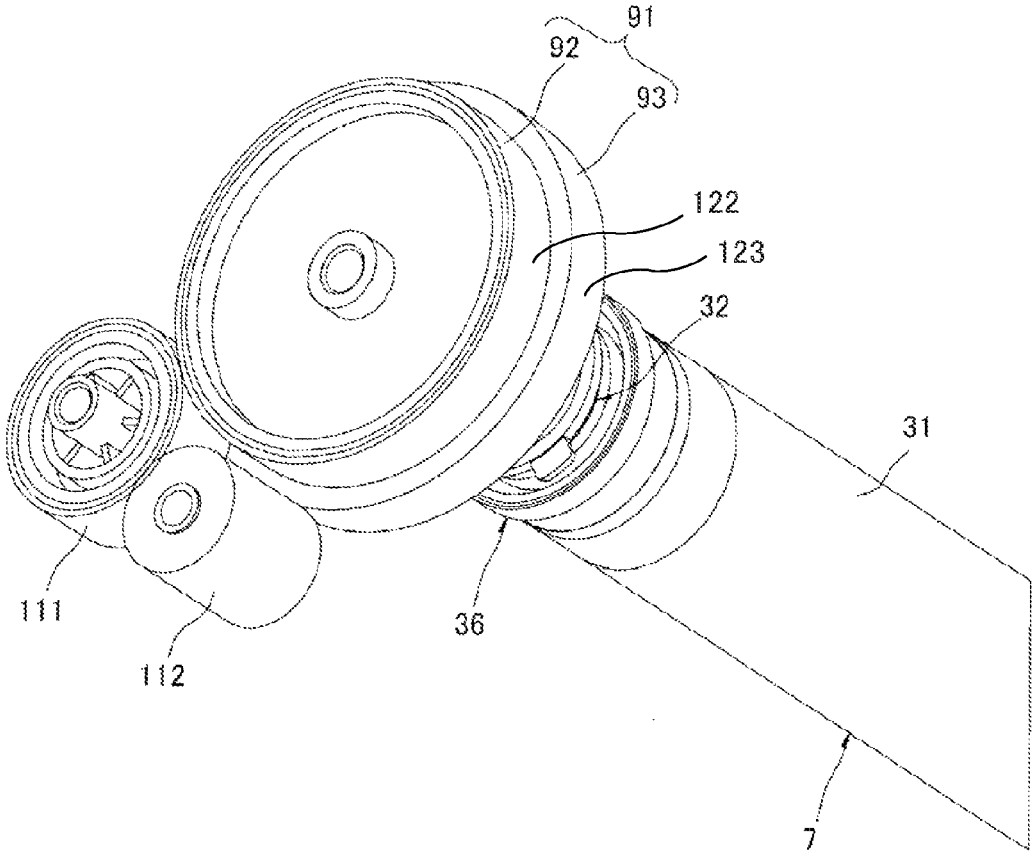
FIG. 11 is a perspective view of a photosensitive drum, a drive transmitting member, a first main body driving gear, and a second main body driving gear according to still another embodiment of the present disclosure.
Figure 12:
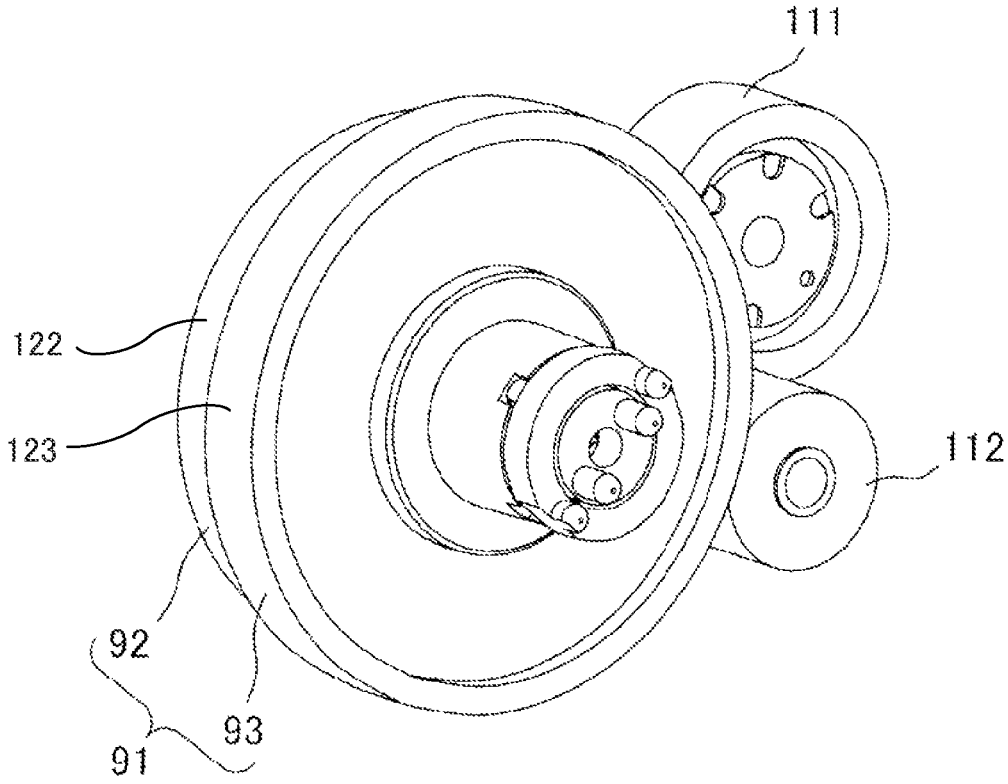
FIG. 12 is a perspective view of the drive transmitting member, the first main body driving gear, and the second main body driving gear shown in FIG. 11.

In the configuration shown in FIGS. 11 and 12, the gear teeth 122 (as an example of a first gear portion) of the first gear 92 and the gear teeth 123 (as an example of a second gear portion) of the second gear 93 of the drive transmitting gear 91 mesh with a first main body driving gear 111 as an example of a first driving gear and a second main body driving gear 112 as an example of a second driving gear, respectively. The second main body driving gear 112 meshes with the first main body driving gear 111.

The driving force of a motor (not shown) installed in the main body casing 2 is input into the first main body driving gear 111. The driving force is then transmitted from the first main body driving gear 111 to the first gear 92, and is transmitted from the first gear 92 via the first joint 78, the driven side first protrusions 81, and the driven side first groove 35 to the flange 32. On the other hand, the driving force input into the first main body driving gear 111 is transmitted from the first main body driving gear 111 to the second main body driving gear 112, and is transmitted from the first main body driving gear 112 to the second gear 93. Thus, the second gear 93 rotates in a direction opposite to the first gear 91. The driving force transmitted to the second gear 93 is transmitted via the second joint 79, the driven side second protrusions 83, and the driven side second groove 39 to the cleaning driving gear 36.

In this configuration, the primary cleaning roller 10 rotates in the same direction as the rotational direction of the photosensitive drum 7 (against rotation) so that the surface thereof moves in a direction opposite to the surface of the photosensitive drum 7 in the part of contact with the photosensitive drum 7. For this reason, frictional force is applied to the surface of the photosensitive drum 7 from the primary cleaning roller 10, and this frictional force resists the rotation of the photosensitive drum 7. Therefore, the photosensitive drum 7 is rotated in a state where a weak braking force is always applied thereto (a state where a loose brake is always put thereon). As a result, the rotation speed of the photosensitive drum 7 can be further stabilized. In addition, it is not necessary to additionally provide a braking member, an urging member, and so forth for the stabilization of the rotation speed, and therefore the increase in cost can be prevented.

<Modification>

In the above-described embodiments, a driven side first groove 35 as an example of a first groove and a driven side second groove 39 as an example of a second groove are formed in the flange 32 and the cleaning driving gear 36, respectively, and driven side first protrusions 81 as an example of first protrusions and driven side second protrusions 83 as an example of second protrusions are formed on the first joint 78 and the second joint 79, respectively. However, these groove-protrusion relationships may be reversed. That is, a first groove may be formed in the flange 32, and first protrusions may be formed on the first joint 78. A second groove may be formed in the cleaning driving gear 36, and second protrusions may be formed on the second joint 79. Various design changes may be made in the above-described embodiments within the range of the claims.

REFERENCE SIGNS LIST

1: color printer
10: primary cleaning roller
32: flange
35: driven side first groove
36: cleaning driving gear
39: driven side second groove
72: drive transmitting gear
73: intermediate member
78: first joint
79: second joint
81: driven side first protrusion
83: driven side second protrusion
84: Oldham coupling
92: first gear
93: second gear
102: main body driving gear
111: first main body driving gear
112: second main body driving gear

The invention claimed is:

1. A coupling comprising:
a driving side member;
a driven side member; and an intermediate member interposed between the driving side member and the driven side member and configured to transmit a driving force from the driving side member to the driven side member, wherein the driven side member has:

a first driven side rotating body having a first engaging portion; and a second driven side rotating body having a second engaging portion, wherein the second driven side rotating body is configured to rotate relative to the first driven side rotating body about a common axis of rotation with the first driven side rotating body, wherein the second engaging portion is disposed outside of the first engaging portion with respect to a radial direction of the first driven side rotating body, wherein the intermediate member has:

a first joint having a first engaged portion configured to engage with the first engaging portion; and a second joint having a second engaged portion configured to engage with the second engaging portion; and wherein the driving side member has:

a first driving side rotating body configured to couple with the first joint, and a second driving side rotating body configured to couple with the second joint.

2. The coupling according to claim 1, wherein the first driving side rotating body is independent from the second driving side rotating body.

3. The coupling according to claim 1, wherein the first engaging portion is a pair of first protrusions formed about the axis of rotation of the first driven side rotating body and protruding toward the first engaged portion, wherein the first engaged portion is a first groove configured to engage with the pair of first protrusions, wherein the second engaging portion is a pair of second protrusions formed about the axis of rotation of the second driven side rotating body and protruding toward the second engaged portion, wherein the second engaged portion is a second groove configured to engage with the pair of second protrusions.

4. The coupling according to claim 1, wherein the first engaging portion is a pair of first protrusions formed about the axis of rotation of the first driven side rotating body and protruding toward the first engaged portion, wherein the first engaged portion is a first groove configured to engage with the pair of first protrusions, wherein the second engaged portion is a pair of second protrusions formed about the axis of rotation of the second joint and protruding toward the second engaging portion, wherein the second engaging portion is a second groove configured to engage with the pair of second protrusions.

5. The coupling according to claim 1, wherein the first engaged portion is a pair of first protrusions formed about the axis of rotation of the first joint and protruding toward the first engaging portion, wherein the first engaging portion is a first groove configured to engage with the pair of first protrusions, wherein the second engaged portion is a pair of second protrusions formed about the axis of rotation of the second joint and protruding toward the second engaging portion, wherein the second engaging portion is a second groove configured to engage with the pair of second protrusions.

6. The coupling according to claim 1, wherein the first engaged portion is a pair of first protrusions formed about the axis of rotation of the first joint and protruding toward the first engaging portion, wherein the first engaging portion is a first groove configured to engage with the pair of first protrusions, wherein the second engaging portion is a pair of second protrusions formed about the axis of rotation of the second driven side rotating body and protruding toward the second engaged portion, wherein the second engaged portion is a second groove configured to engage with the pair of second protrusions.

7. The coupling according to claim 1, wherein the coupling is configured to be an Oldham coupling.

8. An image forming apparatus comprising:

a photosensitive drum configured to rotate about an axis of rotation;

a driven member disposed proximate the photosensitive drum and configured to be rotationally driven about an axis parallel to the axis of rotation of the photosensitive drum;

a driving member; and a coupling configured to transmit a driving force from the driving member to the photosensitive drum and the driven member simultaneously and independently of each other;

wherein the coupling includes:

a driving side member;

a driven side member; and an intermediate member interposed between the driving side member and the driven side member and configured to transmit a driving force from the driving side member to the driven side member, wherein the driven side member has:

a first driven side rotating body having a first engaging portion; and a second driven side rotating body having:

a second engaging portion; and a gear portion configured to transmit a driving force to the driven member, wherein the second engaging portion is disposed outside of the first engaging portion with respect to a radial direction of the first driven side rotating body, wherein the first driven side rotating body is configured to rotate together with the photosensitive drum about a common axis of rotation with the photosensitive drum, wherein the second driven side rotating body is configured to rotate relative to the first driven side rotating body about the common axis of rotation with the first driven side rotating body, and wherein the intermediate member has:

a first joint having a first engaged portion configured to engage with the first engaging portion; and a second joint having a second engaged portion configured to engage with the second engaging portion.

9. The image forming apparatus according to claim 8, wherein the coupling is configured to be an Oldham coupling.

* * * * *